US011158235B2

(12) United States Patent
Xu et al.

(10) Patent No.: US 11,158,235 B2
(45) Date of Patent: Oct. 26, 2021

(54) COLOR DISPLAY PANEL AND CONTROL METHOD THEREOF

(71) Applicants: Shenzhen Absen Optoelectronic Co., Ltd., Guangdong (CN); Huizhou Absen Optoelectronic Co., Ltd., Guangdong (CN)

(72) Inventors: Mengmeng Xu, Guangdong (CN); Changjin Shi, Guangdong (CN); Boxue Xie, Guangdong (CN)

(73) Assignees: Shenzhen Absen Optoelectronic Co., Ltd., Guangdong (CN); Huizhou Absen Optoelectronic Co., Ltd., Guangdong (CN)

( * ) Notice: Subject to any disclaimer, the term of this patent is extended or adjusted under 35 U.S.C. 154(b) by 0 days.

(21) Appl. No.: 17/052,765

(22) PCT Filed: Jul. 22, 2019

(86) PCT No.: PCT/CN2019/097129

§ 371 (c)(1),
(2) Date: Nov. 3, 2020

(87) PCT Pub. No.: WO2021/012157

PCT Pub. Date: Jan. 28, 2021

(65) Prior Publication Data

US 2021/0264841 A1 Aug. 26, 2021

(51) Int. Cl.
*G09G 3/20* (2006.01)

(52) U.S. Cl.
CPC ..... *G09G 3/2074* (2013.01); *G09G 3/2003* (2013.01); *G09G 2300/0452* (2013.01)

(58) Field of Classification Search
CPC ..... G09G 3/2074; G09G 3/2003; G09G 2300/0452
See application file for complete search history.

(56) References Cited

U.S. PATENT DOCUMENTS

2003/0214243 A1* 11/2003 Drobot ..... H01J 11/18 315/169.3
2004/0201558 A1 10/2004 Arnold et al.
(Continued)

FOREIGN PATENT DOCUMENTS

CN 102142210 A 8/2011
CN 102201183 A 9/2011
(Continued)

OTHER PUBLICATIONS

English translation of CN 206210351 U. (Year: 2017).*
(Continued)

*Primary Examiner* — Stephen G Sherman
(74) *Attorney, Agent, or Firm* — IP Spring

(57) ABSTRACT

A color display panel and a control method thereof are provided. The color display panel includes pixel units arranged in an array, and each pixel unit at least includes a red sub-pixel unit, a green sub-pixel unit, a blue sub-pixel unit, and a white sub-pixel unit, where white light of the color display panel is achieved through the white sub-pixel unit. With aid of the above, the white light of the color display panel of the disclosure is realized by a single white sub-pixel unit, which can effectively alleviate color separation during mixing of red, green, and blue light of traditional display panels, and greatly improve the display effect of the display panel.

10 Claims, 6 Drawing Sheets

(56) References Cited

U.S. PATENT DOCUMENTS

| | | | | |
|---|---|---|---|---|
| 2008/0225143 | A1* | 9/2008 | Joffer | G09F 9/3026 348/280 |
| 2011/0084990 | A1* | 4/2011 | An | G09G 3/3648 345/690 |
| 2016/0035292 | A1* | 2/2016 | Lee | G09G 3/3648 345/694 |

FOREIGN PATENT DOCUMENTS

| | | | |
|---|---|---|---|
| CN | 103093722 | A | 5/2013 |
| CN | 103632618 | A | 3/2014 |
| CN | 104269138 | A | 1/2015 |
| CN | 204834691 | U | 12/2015 |
| CN | 105679235 | A | 6/2016 |
| CN | 105976771 | A | 9/2016 |
| CN | 206210351 | U | 5/2017 |
| CN | 108184103 | A | 6/2018 |
| CN | 108206234 | A | 6/2018 |
| CN | 109327689 | A | 2/2019 |
| CN | 109935600 | A | 6/2019 |

OTHER PUBLICATIONS

English translation of CN 102142210 A. (Year: 2011).*
CNIPA, International Search Report for International Patent Application No. PCT/CN2019/097129, dated Mar. 21, 2020, 6 pages.

* cited by examiner

COLOR DISPLAY PANEL AND CONTROL METHOD THEREOF

CROSS-REFERENCE TO RELATED APPLICATION

The present application is the U.S. National Stage filing under 35 U.S.C. § 371 of International Application No. PCT/CN2019/097129, filed on Jul. 22, 2019.

TECHNICAL FIELD

This disclosure relates to the technical field of displays, and particularly to a color display panel and a control method thereof.

BACKGROUND

Full-color light-emitting diode (LED) displays are widely used in the field of display of internal and external walls in public places such as shopping malls, airports, and railway stations because the full-color LED display has the advantages of wide display color gamut, high brightness, large viewing angle, low power consumption, long service life, and the like. At present, pixel units of the full-color LED displays on the market are made of LED chips of three primary colors (red, green, and blue). According to the principle of the three primary colors, various colors can be produced by controlling a monochrome gray level of the LED chips in the pixel units, such that a color picture can be displayed.

White light of the full-color LED display is generated by mixing red light, green light, and blue light. However, since the red LED chip, the green LED chip, and the blue LED chip are not in a same position, and light-emitting points of the LED chips of three primary colors (red, green, and blue) are separated from each other, uneven color mixing and color separation may occur on the display.

SUMMARY

The disclosure provides a color display panel and a control method thereof, which can solve the problem of color separation during light mixing of three primary color displays in the related art.

To solve the above technical problems, a color display panel is provided. The color display panel includes pixel units arranged in an array, and each pixel unit at least includes a red sub-pixel unit, a green sub-pixel unit, a blue sub-pixel unit, and a white sub-pixel unit, where white light of the color display panel is achieved through the white sub-pixel unit.

To solve the above technical problems, a control method is provided. The control method is applicable to the color display panel described above and includes the following. A value of a red channel, a value of a green channel, and a value of a blue channel in an input signal are acquired. The method determines whether the red channel, the green channel, and the blue channel have a same value. The method turns on the white sub-pixel unit in the color display panel and turns off the red sub-pixel unit, the green sub-pixel unit, and the blue sub-pixel unit in the color display panel, based on a determination that the red channel, the green channel, and the blue channel have the same value. A gray value of the white sub-pixel unit is determined according to the same value and a brightness value of the white sub-pixel unit is controlled according to the γ curve, such that the color display panel displays brightness and color corresponding to the input signal.

According to the color display panel of the disclosure, the color display panel includes the pixel units arranged in an array, and each pixel unit at least includes a red sub-pixel unit, a green sub-pixel unit, a blue sub-pixel unit, and a white sub-pixel unit, where white light of the color display panel is achieved through the white sub-pixel unit. The white light of the color display panel of the disclosure is realized by a single white sub-pixel unit, which can effectively alleviate color separation during light mixing of traditional display panels of three primary colors (red, green, and blue), and greatly improve the display effect of the display panel.

BRIEF DESCRIPTION OF THE DRAWINGS

To describe technical solutions in implementations of the disclosure more clearly, the following briefly introduces accompanying drawings required for illustrating the implementations. Apparently, the accompanying drawings in the following description illustrate some implementations. Those of ordinary skill in the art may also obtain other drawings based on these accompanying drawings without creative efforts.

FIG. 3(*b*) is a schematic top view of the package structure in FIG. 3(*a*).

FIG. 4(*b*) is a schematic top view of the package structure in FIG. 4(*a*).

DETAILED DESCRIPTION

Figure 1:
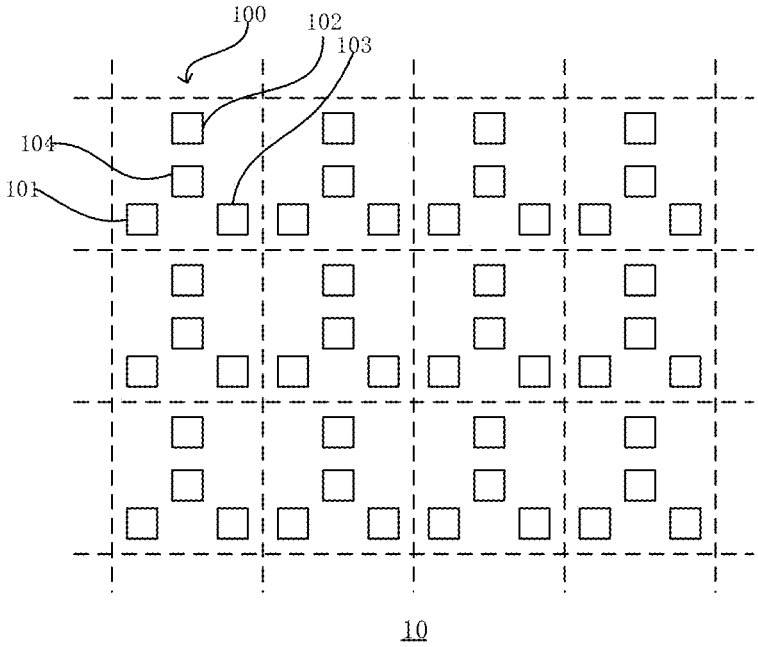
FIG. 1 is a schematic structural diagram of a color display panel according to implementations of the disclosure.

In order to enable those skilled in the art to better understand technical solutions, a color display panel and a control method thereof provided herein will be described in a clear and comprehensive manner in conjunction with implementations and the accompanying drawings.

At present, full-color light-emitting diode (LED) displays have been widely used in the field of displays. In pixel units of the LED display, LED chips of three primary colors (red, green, and blue) are not in a same position, and light-emitting points of the LED chips of three primary colors (red, green, and blue) are separated from each other. Therefore, the three primary colors of red, green, and blue in the pixels are not uniformly mixed. Actually, color pixels displayed by the LED display are represented as the separated light-emitting points of the LED chips of three primary colors (red, green, and blue). When an observer is relatively far away from the LED display, it is difficult for the eyes of the observer to distinguish the separated light-emitting points, and thus the display effect may not be affected. However, when the observer is relatively close to the LED display and distances among the LED chips of three primary colors (red, green, and blue) are large, it is easy for the eyes to distinguish the separated light-emitting points of the LED chips of three primary colors (red, green, and blue). In this case, each color pixel is represented as a separated light-emitting point of RGB, the color separation is obvious, and the display effect is poor. Especially when the LED display displays a large area of white pixels, the color separation may be more obvious.

Therefore, if the distances among the LED chips are reduced, i.e., the LED chips are arranged densely, the color separation in the pixels can be improved, which in turn may greatly increase the difficulty of layout and heat dissipation of printed circuit boards and may also sharply increase the cost.

In addition, if a total reflection light-homogenizing device is arranged in the front of the LED display, with the aid of the principle of total reflection, light emitted by the LED chips of three primary colors (red, green, and blue) in the pixels may be mixed uniformly, such that the color separation can be improved. Alternatively, if a screen cover is arranged in the front of the LED display, with the aid of scattering units of the screen cover, light emitted by the LED chips of three primary colors (red, green, and blue, RGB) in the pixels can also be mixed uniformly, and therefore the color separation can also be improved. However, the above methods need to arrange a functional layer (such as a total reflection light-homogenizing layer or a scattering layer) on the LED display, which is complicated in process. In addition, to achieve a better light homogenization effect, a thicker functional layer is required, which may greatly increase the thickness of the LED display. Furthermore, arranging the functional layer on the LED display also makes subsequent maintenance more difficult.

In view of the above, the disclosure provides a color display panel and a control method thereof, which can improve the color separation without introducing the problems described above. In addition, the method provided by the disclosure is simple in process, and there is no need to increase the thickness of the display panel, such that subsequent maintenance and replacement may also be facilitated.

Referring to FIG. 1, FIG. 1 is a schematic structural diagram of a color display panel according to implementations of the disclosure. The color display panel 10 of the disclosure includes pixel units 100 arranged in an array. Each of the pixel units 100 at least includes a red sub-pixel unit 101, a green sub-pixel unit 102, a blue sub-pixel unit 103, and a white sub-pixel unit 104. White light of the color display panel 10 is achieved through the white sub-pixel unit 104. When the color display panel 10 needs to display white light, the color display panel 10 can turn on the white sub-pixel unit 104 and turn off the red sub-pixel unit 101, the green sub-pixel unit 102, and the blue sub-pixel unit 103.

As can be seen, the white light of the color display panel of the disclosure is realized through a single white sub-pixel unit, which can effectively avoid color separation occurring when red light, green light, and blue light are mixed into white light, thereby greatly improving the display effect of the display panel. In addition, the color display panel of the disclosure has simple process, and there is no need to increase the thickness of the LED display, which is conducive to subsequent maintenance and replacement.

According to implementations, sub-pixel units of the pixel unit may be arranged in a triangle. As illustrated in FIG. 1, the white sub-pixel unit 104 is disposed at the center of the pixel unit 100, and the center of the pixel unit 100 can be deemed as a geometric center of the pixel unit 100 or a center position of a pattern which is formed by the red sub-pixel unit 101, the green sub-pixel unit 102, and the blue sub-pixel unit 103. The red sub-pixel unit 101, the green sub-pixel unit 102, and the blue sub-pixel unit 103 are arranged in a triangle, for example, arranged in an equilateral triangle, so as to make the color mixing more uniform. The white sub-pixel unit 104 is disposed at the center of the triangle formed by the red sub-pixel unit 101, the green sub-pixel unit 102, and the blue sub-pixel unit 103.

The red sub-pixel unit 101, the green sub-pixel unit 102, the blue sub-pixel unit 103, and the white sub-pixel unit 104 constitute the pixel unit 100, and multiple pixel units 100 are arranged in an array to form the color display panel 10.

In other implementations, sub-pixel units of the color display panel can also adopt other arrangements, such as a rectangular arrangement, a linear arrangement, or the like.

Figure 2:
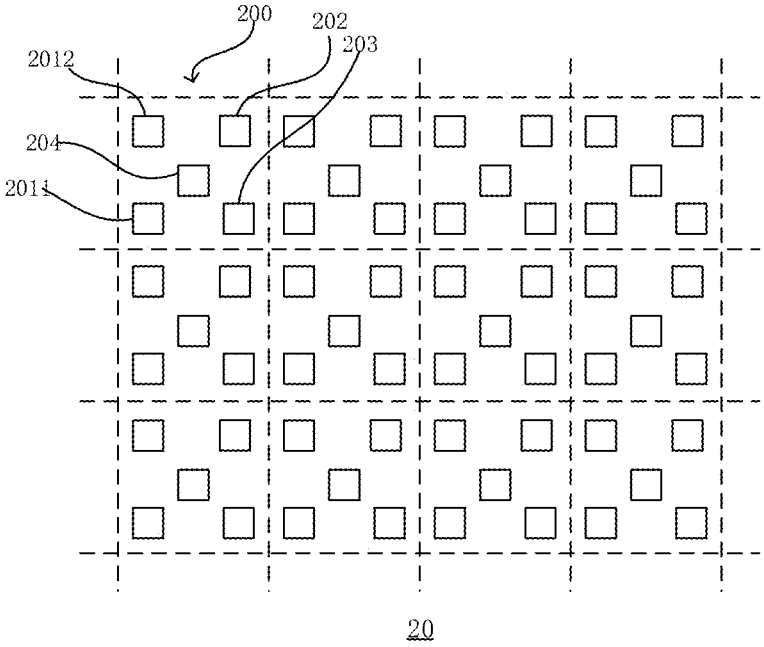
FIG. 2 is a schematic structural diagram of a color display panel according to other implementations of the disclosure.

To achieve different display effects, for each pixel unit, there can be more than one red sub-pixel units, green sub-pixel units, blue sub-pixel units, or white sub-pixel units. Referring to FIG. 2, FIG. 2 is a schematic structural diagram of a color display panel according to other implementations of the disclosure. According to implementations, a pixel unit 200 includes two red sub-pixel units 2011 and 2012, a green sub-pixel unit 202, a blue sub-pixel unit 203, and a white sub-pixel unit 204. The two red sub-pixel units 2011 and 2012, the green sub-pixel unit 202, and the blue sub-pixel unit 203 are arranged in a rectangle. The white sub-pixel unit 204 is disposed at the center of the rectangle. The red sub-pixel units include a first red sub-pixel unit 2011 and a second red sub-pixel unit 2012. The first red sub-pixel unit 2011 and the second red sub-pixel unit 2012 are symmetrically disposed relative to the white sub-pixel unit 204.

In other implementations, to achieve other display effects, those skilled in the art can understand that the number of sub-pixel units of other colors can be set to be greater than one or the sub-pixel units of other colors may adopt different arrangements.

In one example, for each pixel unit of the disclosure, the four sub-pixel units (such as, the red sub-pixel unit, the green sub-pixel unit, the blue sub-pixel unit, and the white sub-pixel unit) each may be separately packaged by adopting dual inline-pin package (DIP), surface mounted devices (SMD) package, chips on board (COB) package, or other manner of packaging. Alternatively, the four sub-pixel units (namely, the red sub-pixel unit, the green sub-pixel unit, the blue sub-pixel unit, and the white sub-pixel unit) are integrally packaged by adopting DIP, SMD package, COB package, or other manner of packaging.

Figure 3A:
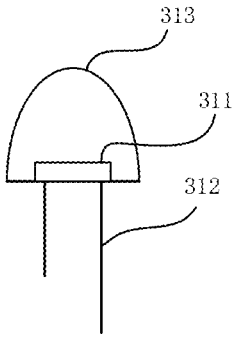
FIG. 3(*a*) is a schematic structural diagram of an individually packaged red sub-pixel unit according to implementations of the disclosure.
Figure 3B:
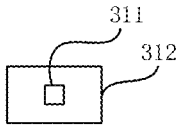

As illustrated in FIG. 3(*a*) and FIG. 3(*b*), FIG. 3(*a*) is a schematic structural diagram of an individually packaged red sub-pixel unit according to implementations of the disclosure, and FIG. 3(*b*) is a schematic top view of the package structure in FIG. 3(*a*). In the implementation, with DIP, the red sub-pixel unit is individually packaged as a red lamp bead. The red lamp bead may include a red light-emitting chip 311, a bracket 312, and an outer cover 313. The bracket 312 and the outer cover 313 collectively define an enclosed space, and the red light-emitting chip 311 is disposed in the enclosed space. The red light-emitting chip 311 may be a red LED bare chip. The red light-emitting chip 311 emits light so as to form the red sub-pixel unit.

In one example, the bracket 312 may include a base and a set of pins. The base is configured to support the red light-emitting chip 311, and the set of pins is configured to connect the red light-emitting chip 311 to an external circuit. The outer cover 313 may be an encapsulating glue structure, and the encapsulating glue structure may be a transparent optical glue structure made of epoxy resin or silica gel. The outer cover 313 may include a scattering particle layer and/or a colorant layer. The scattering particle layer is configured to control a light-emitting angle of the red light-emitting chip. The colorant layer can absorb visible light of other colors except red light, which can improve the contrast of the display.

The blue lamp bead and the green lamp bead are packaged similar as the red lamp bead, and thus the blue lamp bead and the green lamp bead may be obtained by replacing the red light-emitting chip and the colorant layer with a light-emitting chip of a corresponding color and a colorant layer of a corresponding color, which are not be repeated herein.

It should be noted that, for a white lamp bead, a light-emitting chip in the white lamp bead may be a blue light-emitting chip, an ultraviolet light-emitting chip, or light-emitting chips of other colors. An outer cover of the white lamp bead includes a phosphor layer. The phosphor layer can absorb light emitted by the light-emitting chip, and convert the light emitted by the light-emitting chip to white light. In one example, the white lamp bead may be provided with a blue light-emitting chip and a YAG:Ce phosphor layer, and the YAG:Ce phosphor layer is configured to convert blue light to white light.

Figure 4A:
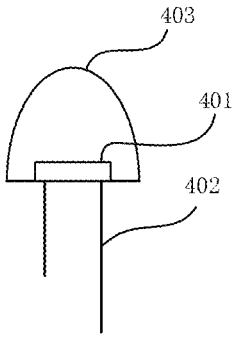
FIG. 4(*a*) is a schematic structural diagram of an integrally packaged pixel unit according to implementations of the disclosure.
Figure 4B:
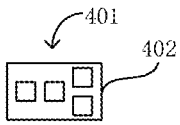

As illustrated in FIG. 4(*a*) and FIG. 4(*b*), FIG. 4(*a*) is a schematic structural diagram of an integrally packaged pixel unit according to implementations of the disclosure, and FIG. 4(*b*) is a schematic top view of the package structure in FIG. 4(*a*). In the implementation, with DIP, the whole pixel unit is packaged as a lamp bead. The lamp bead includes at least four light-emitting chips 401, a bracket 402, and an outer cover 403. The bracket 402 and the outer cover 403 collectively define an enclosed space, and the light-emitting chips 401 are disposed in the enclosed space. The light-emitting chips 401 each may be a LED bare chip. The light-emitting chips 401 include a red light-emitting chip, a green light-emitting chip, a blue light-emitting chip, and an ultraviolet light-emitting chip.

In one example, the bracket 402 may include a base and a set of pins. The base is configured to support the red light-emitting chip, the green light-emitting chip, the blue light-emitting chip, and the ultraviolet light-emitting chip. The set of pins is configured to connect the red light-emitting chip, the green light-emitting chip, the blue light-emitting chip, and the ultraviolet light-emitting chip to an external circuit. The outer cover 403 may be an encapsulating glue structure, and the encapsulating glue structure may be a transparent optical glue structure made of epoxy resin or silica gel. The outer cover 403 may further include a phosphor layer, a scattering particle layer, and/or a colorant layer. The scattering particle layer is configured to control light-emitting angles of the light-emitting chips 401. The colorant layer can absorb light of other colors except red light, green light, and blue light, which can improve the contrast of the display.

The red light-emitting chip emits light so as to form a red sub-pixel unit, the green light-emitting chip emits light so as to form a green sub-pixel unit, the blue light-emitting chip emits light so as to form a blue sub-pixel unit, and the ultraviolet light-emitting chip emits ultraviolet light. The phosphor layer in the outer cover 403 absorbs the ultraviolet light and converts the ultraviolet light to white light, so as to form a white sub-pixel unit. In one example, the phosphor layer does not absorb light of the three primary colors of red, green, and blue, which can ensure the chromaticity of the display.

In addition, implementations of the disclosure provide a method for determining the maximum brightness of each sub-pixel unit in a red, green, blue, and white (RGBW) color display panel. The method includes the following.

Color coordinates and the maximum brightness of the white sub-pixel unit of the color display panel are respectively set to be white balance coordinates and the maximum brightness of the white light of the color display panel. The maximum brightness of the red sub-pixel unit, the maximum brightness of the green sub-pixel unit, and the maximum brightness of the blue sub-pixel unit are set according to the white balance coordinates, the maximum brightness of the white sub-pixel unit, color coordinates of the red sub-pixel unit, color coordinates of the green sub-pixel unit, and color coordinates of the blue sub-pixel unit.

In the implementation, the maximum brightness of the red sub-pixel unit, the maximum brightness of the green sub-pixel unit, and the maximum brightness of the blue sub-pixel unit are determined according to following formula (1):

$$\begin{pmatrix} \frac{x_r}{y_r} & \frac{x_g}{y_g} & \frac{x_b}{y_b} \\ 1 & 1 & 1 \\ \frac{z_r}{y_r} & \frac{z_g}{y_g} & \frac{z_b}{y_b} \end{pmatrix} \begin{pmatrix} L_{rm} \\ L_{gm} \\ L_{bm} \end{pmatrix} = \begin{pmatrix} \frac{x_w}{y_w} L_{wm} \\ L_{wm} \\ \frac{z_w}{y_w} L_{wm} \end{pmatrix} \tag{1}$$

where $z_r=1-x_r-y_r$, $z_g=1-x_g-y_g$, $z_b=1-x_b-y_b$, $z_w=1-x_w-y_w$.

In the formula (1), $(x_w, y_w)$ represents the color coordinates of the white sub-pixel unit, $L_{wm}$ represents the maximum brightness of the white light; $(x_r, y_r)$ represents the color coordinates of the red sub-pixel unit, $L_{rm}$ represents the maximum brightness of red light; $(x_g, y_g)$ represents the color coordinates of the green sub-pixel unit, $L_{gm}$ represents the maximum brightness of green light; $(x_b, y_b)$ represents the color coordinates of the blue sub-pixel unit, and $L_{bm}$ represents the maximum brightness of blue light.

Figure 5:
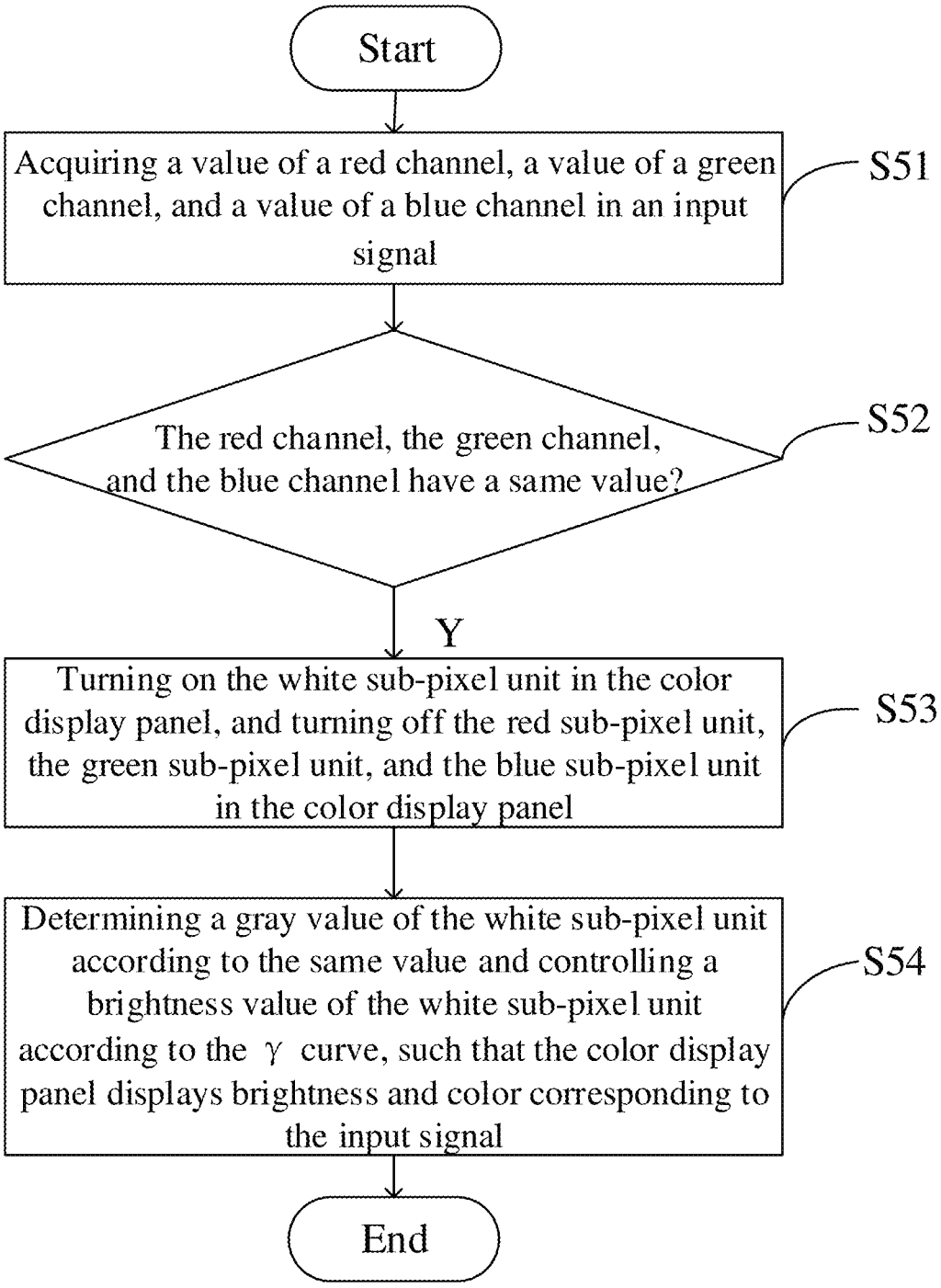
FIG. 5 is a schematic flow chart of a control method according to implementations of the disclosure.

Implementations of the disclosure provide a control method. The control method is applicable to the color display panel described above. As illustrated in FIG. 5, FIG. 5 is a schematic flow chart of a control method according to implementations of the disclosure. The control method is applicable to a RGB color system and the method begins at S51.

At S51, a value of a red channel, a value of a green channel, and a value of a blue channel in an input signal are acquired.

RGB color mode uses a RGB model to assign a value ranging from 0 to 255 for a RGB component of each pixel in an image. In the RGB mode, each RGB component can be represented by a value ranging from 0 (black) to 255 (white). RGB represents colors of three channels of red, green, and blue, and each color channel corresponds to a value.

The color display panel includes a controller. The controller can acquire the value of the red channel, the value of the green channel, and the value of the blue channel in the input signal.

At S52, the method determines whether the red channel, the green channel, and the blue channel have a same value.

The controller can determine whether the value of the red channel, the value of the green channel, and the value of the blue channel are the same. If so, the method proceeds to operations at S53.

At S53, the white sub-pixel unit in the color display panel is turned on, and the red sub-pixel unit, the green sub-pixel unit, and the blue sub-pixel unit in the color display panel are turned off.

When the controller determines that the value of the red channel, the value of the green channel, and the value of the blue channel are the same, it indicates that a color to be displayed in the input signal is white, and thus the white sub-pixel unit in the color display panel may be turned on, and the red sub-pixel unit, the green sub-pixel unit, and the blue sub-pixel unit in the color display panel may be turned off. In the implementation, the controller of the color display panel controls a single white sub-pixel unit to emit light to display white light, compared with displaying the white light by mixing light of three primary colors of red, green, and blue, and color separation can be avoided.

At S54, a gray value of the white sub-pixel unit is determined according to the same value and a brightness value of the white sub-pixel unit is controlled according to the γ curve, such that the color display panel displays brightness and color corresponding to the input signal.

Since the value of the red channel, the value of the green channel, and the value of the blue channel are all the same, the color display panel in the implementation can select the value of any of the red channel, the green channel, and the blue channel in the input signal to determine the gray value of the white sub-pixel unit. In one example, the controller may determine the gray value of the white sub-pixel unit according to the value of the red channel, that is, the controller can set the gray value of the white sub-pixel unit to be the value of the red sub-pixel unit (that is, the red channel).

In addition, the controller controls the brightness value of the white sub-pixel unit according to the γ curve to correct the display effect, such that the color display panel can display the brightness and color corresponding to the input signal.

Figure 6:
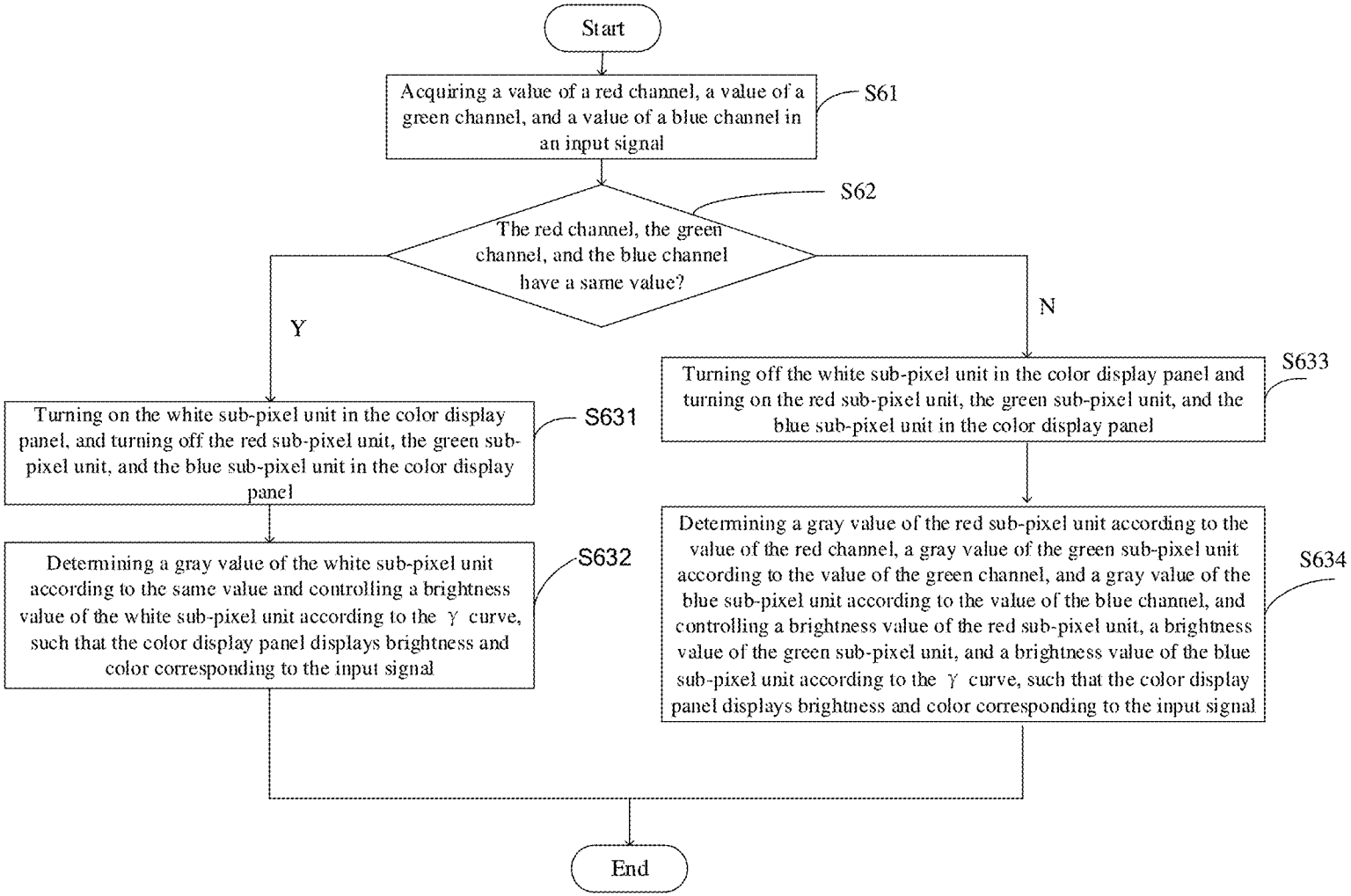
FIG. 6 is a schematic flow chart of a control method according to other implementations of the disclosure.

FIG. 6 is a schematic flow chart of a control method according to other implementations of the disclosure. In the implementation, for the operations similar to that in the above method implementation, reference may be made to the above method implementation, which is not repeated herein. As illustrated in FIG. 6, the method begins at S61.

At S61, a value of a red channel, a value of a green channel, and a value of a blue channel in an input signal are acquired.

At S62, the method determines whether the red channel, the green channel, and the blue channel have a same value.

Upon determining that the value of the red channel, the value of the green channel, and the value of the blue channel are the same, the method proceeds to operations at S631 to S632; otherwise, the method proceeds to operations at S633~S634.

At S631, the white sub-pixel unit in the color display panel is turned on, and the red sub-pixel unit, the green sub-pixel unit, and the blue sub-pixel unit in the color display panel are turned off.

At S632, a gray value of the white sub-pixel unit is determined according to the same value and a brightness value of the white sub-pixel unit is controlled according to the γ curve, such that the color display panel displays brightness and color corresponding to the input signal.

Operations at S631 to S632 correspond to the above operations S53 to S54, which are not repeated herein.

At S633, the white sub-pixel unit in the color display panel is turned off and the red sub-pixel unit, the green sub-pixel unit, and the blue sub-pixel unit in the color display panel are turned on.

When the controller determines that the value of the red channel, the value of the green channel, and the value of the blue channel are different, it can be determined that a color to be displayed in the input signal is not white, and thus the controller turns off the white sub-pixel unit in the color display panel, and turns on the red sub-pixel unit, the green sub-pixel unit, and the blue sub-pixel unit in the color display panel.

At S634, a gray value of the red sub-pixel unit is determined according to the value of the red channel, a gray value of the green sub-pixel unit is determined according to the value of the green channel, a gray value of the blue sub-pixel unit is determined according to the value of the blue channel, and a brightness value of the red sub-pixel unit, a brightness value of the green sub-pixel unit, and a brightness value of the blue sub-pixel unit are controlled according to the γ curve, such that the color display panel displays brightness and color corresponding to the input signal.

The controller determines the gray value of the red sub-pixel unit according to the value of the red channel, the gray value of the green sub-pixel unit according to the value of the green channel, and the gray value of the blue sub-pixel unit according to the value of the blue channel, and compensates for the brightness deviation in the color display panel according to the γ curve, such that the color display panel can display the brightness and color corresponding to the input signal. The specific method and principle have been described in the above operations at S54, which are not repeated herein.

Figure 7:
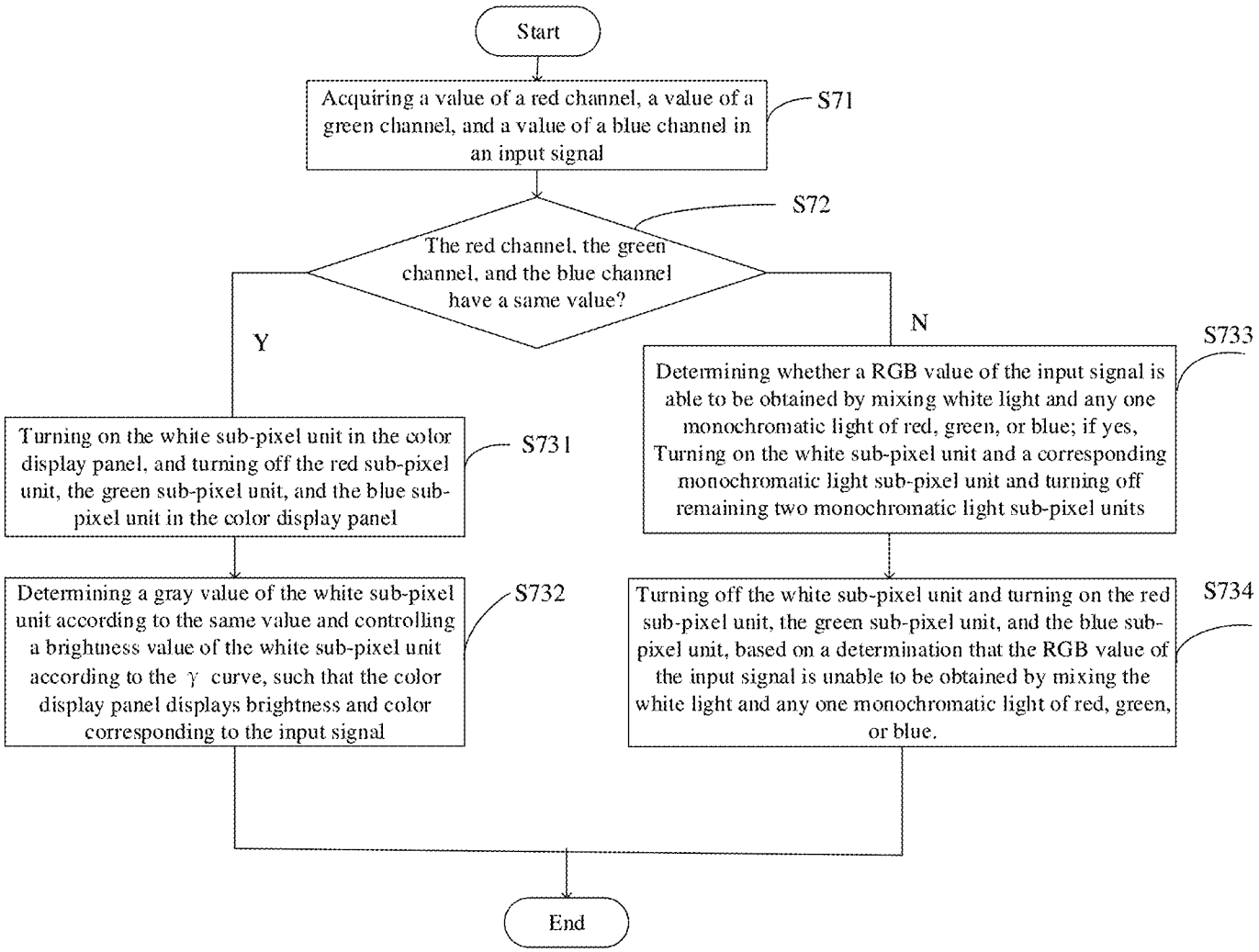
FIG. 7 is a schematic flow chart of a control method according to other implementations of the disclosure.

To further improve the display effect of the color display panel, the disclosure provides other implementations of the control method. FIG. 7 is a schematic flow chart of a control method according to other implementations of the disclosure. The operations in the implementation the same as that in the above implementations will not be repeated herein. As illustrated in FIG. 7, the method begins at S71.

At S71, a value of a red channel, a value of a green channel, and a value of a blue channel in an input signal are acquired.

At S72, the method determines whether the red channel, the green channel, and the blue channel have a same value.

At S731, the white sub-pixel unit in the color display panel is turned on and the red sub-pixel unit, the green sub-pixel unit, and the blue sub-pixel unit in the color display panel are turned off.

At S732, a gray value of the white sub-pixel unit is determined according to the same value and a brightness value of the white sub-pixel unit is controlled according to the γ curve, such that the color display panel displays brightness and color corresponding to the input signal.

Operations at S731~S732 in the implementation are similar to operations at S631~S632 in the above implementations. For specific technical details, reference may be made to the above implementations, which are not repeated herein.

At S733, the method determines whether a RGB value of the input signal is able to be obtained by mixing white light and any one monochromatic light of red, green, or blue; if yes, the white sub-pixel unit and a corresponding monochromatic light sub-pixel unit are turned on and remaining two monochromatic light sub-pixel units are turned off.

Figure 8:
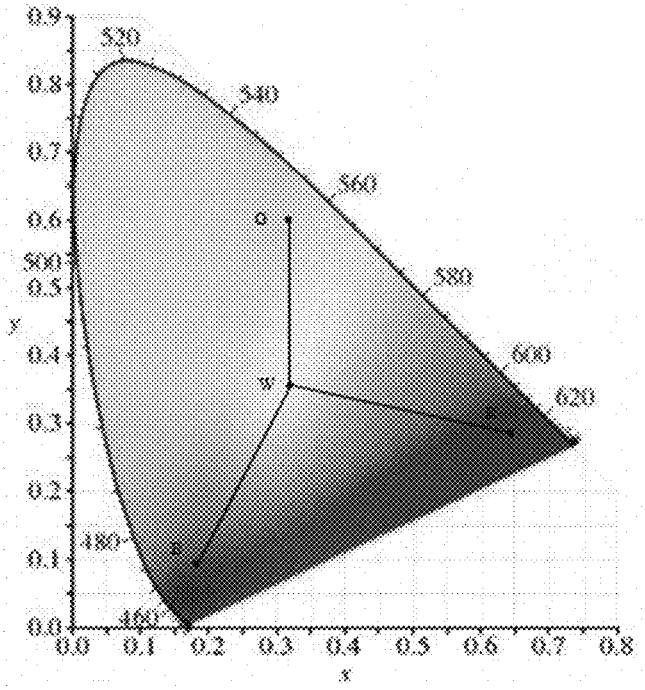
FIG. 8 is a schematic diagram of color coordinates in the control method according to implementations of the disclosure.

The controller determines the brightness $L_r$, $L_g$, and $L_b$ which are respectively correspond to the red sub-pixel unit, the green sub-pixel unit, and the blue sub-pixel unit according to the γ curve. The controller calculates color coordinates ($x_i$, $y_i$) and the brightness Li corresponding to the input signal according to the following formula 2. The controller determines whether the color coordinates ($x_i$, $y_i$) corresponding to the input signal are located on a connection between color coordinates of the white sub-pixel unit and color coordinates of the red sub-pixel unit, color coordinates of the green sub-pixel unit, or color coordinates of the blue sub-pixel unit in a color coordinate system. That is, the controller determines whether the color coordinates ($x_i$, $y_i$) corresponding to the input signal are located on a line segment RW, BW, or GW in FIG. 8, where FIG. 8 is a schematic diagram of color coordinates according to implementations of the disclosure. The formula 2 is:

$$\begin{pmatrix} \frac{x_r}{y_r} & \frac{x_g}{y_g} & \frac{x_b}{y_b} \\ 1 & 1 & 1 \\ \frac{z_r}{y_r} & \frac{z_g}{y_g} & \frac{z_b}{y_b} \end{pmatrix} \begin{pmatrix} L_r \\ L_g \\ L_b \end{pmatrix} = \begin{pmatrix} \frac{x_i}{y_i} L_i \\ L_i \\ \frac{z_i}{y_i} L_i \end{pmatrix} \tag{2}$$

where $z_r=1-x_r-y_r$, $z_g=1-x_g-y_g$, $z_b=1-x_b-y_b$, $z_i=1-x_i-y_i$.

If the color coordinates ($x_i$, $y_i$) corresponding to the input signal are located on the line segment RW, BW, or GW in FIG. 8, it indicates that the color of the input signal can be realized by mixing light emitted by the white sub-pixel unit and light emitted by an X-color (that is, any one of red, green, and blue) sub-pixel unit. The brightness $L_w$ of the white sub-pixel unit and the brightness $L_x$ of the X-color sub-pixel unit can be calculated according to the following formula 3, and then the color display panel can control the brightness of the white sub-pixel unit and the brightness of the X-color sub-pixel unit according to $L_x$, and $L_x$, respectively. Therefore, the color display panel can display brightness and color corresponding to the input signal. Compared with a display panel based on three colors of RGB in which the color is obtained by mixing light emitted by RGB sub-pixel units, the color is obtained by mixing white light and light emitted by the X-color sub-pixel unit. As such, the color separation in the display panel can be improved. The formula 3:

$$\begin{pmatrix} \frac{x_x}{y_x} & \frac{x_w}{y_w} \\ 1 & 1 \\ \frac{z_x}{y_x} & \frac{z_w}{y_w} \end{pmatrix} \begin{pmatrix} L_x \\ L_w \end{pmatrix} = \begin{pmatrix} \frac{x_i}{y_i} L_i \\ L_i \\ \frac{z_i}{y_i} L_i \end{pmatrix} \tag{3}$$

where $z_x-y_x$, $z_w=1-x_w-y_w$.

At S734, the white sub-pixel unit is turned off and the red sub-pixel unit, the green sub-pixel unit, and the blue sub-pixel unit are turned on, based on a determination that the RGB value of the input signal is unable to be obtained by mixing the white light and any one monochromatic light of red, green, or blue.

On the other hand, if the color display panel determines that the color coordinates ($x_i$, $y_i$) corresponding to the input signal are not located on the line segment RW, BW, or GW in FIG. 8, it indicates that the RGB value of the input signal is unable to be obtained by mixing the white light and any one monochromatic light of red, green, or blue. In this case, the color display panel can control the white sub-pixel unit to be turned off and the red sub-pixel unit, the green sub-pixel unit, and the blue sub-pixel unit to be turned on, and determine the gray value of the red sub-pixel unit, the gray value of the green sub-pixel unit, and the gray value of the blue sub-pixel unit according to the RGB value of the input signal. Thereafter, the color display panel can respectively control a brightness value of the red sub-pixel unit, a brightness value of the green sub-pixel unit, and a brightness value of the blue sub-pixel unit according to the γ curve, such that the color display panel can display the color and brightness corresponding to the input signal.

The above are merely some implementations of the disclosure, and are not intended to limit the scope of the disclosure. Any equivalent structure or equivalent process change made according to the description and contents of drawings of the disclosure, or contents directly or indirectly applied to other related technical field all shall fall within the scope of patent protection of the disclosure.

What is claimed is:

1. A color display panel, comprising:

pixel units arranged in an array, wherein each pixel unit at least comprises a red sub-pixel unit, a green sub-pixel unit, a blue sub-pixel unit, and a white sub-pixel unit, wherein white light of the color display panel is achieved through the white sub-pixel unit, and wherein:

color coordinates and maximum brightness of the white sub-pixel unit of the color display panel are respectively set to be white balance coordinates and maximum brightness of the white light of the color display panel; and maximum brightness of the red sub-pixel unit, maximum brightness of the green sub-pixel unit, and maximum brightness of the blue sub-pixel unit are set according to the white balance coordinates, the maximum brightness of the white sub-pixel unit, color coordinates of the red sub-pixel unit, color coordinates of the green sub-pixel unit, and color coordinates of the blue sub-pixel unit.

2. The color display panel of claim 1, wherein the red sub-pixel unit, the green sub-pixel unit, the blue sub-pixel unit, and the white sub-pixel unit adopt a triangular arrangement, a rectangular arrangement, or a linear arrangement.

3. The color display panel of claim 1, wherein the red sub-pixel unit is an individually packaged red lamp bead, the green sub-pixel unit is an individually packaged green lamp bead, the blue sub-pixel unit is an individually packaged blue lamp bead, and the white sub-pixel unit is an individually packaged white lamp bead, and wherein each package is one of dual inline-pin package (DIP), surface mounted devices (SMD) package, or chips on board (COB) package.

4. The color display panel of claim 3, wherein the white lamp bead is provided with a phosphor layer and a light-emitting chip, and wherein:

the light-emitting chip comprises a blue light-emitting chip or an ultraviolet light-emitting chip; and the phosphor layer is configured to convert blue light emitted by the blue light-emitting chip or ultraviolet light emitted by the ultraviolet light-emitting chip into white light.

5. The color display panel of claim 1, wherein each whole pixel unit is packaged as a lamp bead, and wherein the package is one of DIP, SMD package, or COB package.

6. The color display panel of claim 5, wherein the lamp bead is provided with a phosphor layer and light-emitting chips, and wherein:

the light-emitting chips comprise a red light-emitting chip, a green light-emitting chip, a blue light-emitting chip, and an ultraviolet light-emitting chip;

the phosphor layer covers the red light-emitting chip, the green light-emitting chip, the blue light-emitting chip, and the ultraviolet light-emitting chip;

the phosphor layer is configured to convert ultraviolet light emitted by the ultraviolet light-emitting chip into white light; and the phosphor layer does not absorb light emitted by the red light-emitting chip, the green light-emitting chip, and the blue light-emitting chip.

7. A control method applicable to a color display panel, wherein the color display panel comprises pixel units arranged in an array, wherein each pixel unit at least comprises a red sub-pixel unit, a green sub-pixel unit, a blue sub-pixel unit, and a white sub-pixel unit, wherein white light of the color display panel is achieved through the white sub-pixel unit, and wherein color coordinates and maximum brightness of the white sub-pixel unit of the color display panel are respectively set to be white balance coordinates and maximum brightness of the white light of the color display panel, and maximum brightness of the red sub-pixel unit, maximum brightness of the green sub-pixel unit, and maximum brightness of the blue sub-pixel unit are set according to the white balance coordinates, the maximum brightness of the white sub-pixel unit, color coordinates of the red sub-pixel unit, color coordinates of the green sub-pixel unit, and color coordinates of the blue sub-pixel unit, the control method comprising:

acquiring a value of a red channel, a value of a green channel, and a value of a blue channel in an input signal;

determining whether the red channel, the green channel, and the blue channel have a same value;

turning on the white sub-pixel unit in the color display panel and turning off the red sub-pixel unit, the green sub-pixel unit, and the blue sub-pixel unit in the color display panel, based on a determination that the red channel, the green channel, and the blue channel have the same value; and determining a gray value of the white sub-pixel unit according to the same value and controlling a brightness value of the white sub-pixel unit according to a γ curve, such that the color display panel displays brightness and color corresponding to the input signal.

8. The control method of claim 7, further comprising:

turning off the white sub-pixel unit in the color display panel and turning on the red sub-pixel unit, the green sub-pixel unit, and the blue sub-pixel unit in the color display panel, based on a determination that the value of the red channel, the value of the green channel, and the value of the blue channel are different; and determining a gray value of the red sub-pixel unit according to the value of the red channel, a gray value of the green sub-pixel unit according to the value of the green channel, and a gray value of the blue sub-pixel unit according to the value of the blue channel, and controlling a brightness value of the red sub-pixel unit, a brightness value of the green sub-pixel unit, and a brightness value of the blue sub-pixel unit according to the γ curve, such that the color display panel displays brightness and color corresponding to the input signal.

9. The control method of claim 7, further comprising:

determining whether a RGB value of the input signal is able to be obtained by mixing white light and any one monochromatic light of red, green, or blue, based on a determination that the value of the red channel, the value of the green channel, and the value of the blue channel are different; and turning on the white sub-pixel unit and a corresponding monochromatic light sub-pixel unit and turning off remaining two monochromatic light sub-pixel units, based on a determination that the RGB value of the input signal is able to be obtained by mixing the white light and any one monochromatic light of red, green, or blue.

10. The control method of claim 9, further comprising:

turning off the white sub-pixel unit and turning on the red sub-pixel unit, the green sub-pixel unit, and the blue sub-pixel unit, based on a determination that the RGB value of the input signal is unable to be obtained by mixing the white light and any one monochromatic light of red, green, or blue.

* * * * *